United States Patent [19]

Roddis

[11] Patent Number: 4,567,729

[45] Date of Patent: Feb. 4, 1986

[54] METHOD OF FORMING A ZONE CONDENSER WITH A SINGLE LOW PRESSURE DOUBLE FLOW TURBINE

[75] Inventor: Gravatt K. Roddis, Wallingford, Pa.

[73] Assignee: Westinghouse Electric Corp., Pittsburgh, Pa.

[21] Appl. No.: 651,418

[22] Filed: Sep. 17, 1984

[51] Int. Cl.[4] ..... F01K 11/02

[52] U.S. Cl. ..... 60/692; 60/693; 165/111

[58] Field of Search ..... 165/112, 113, 111; 60/690, 692, 693

[56] References Cited

U.S. PATENT DOCUMENTS

| | | | |
|---|---|---|---|
| 3,338,052 | 8/1967 | Holden | 60/690 |
| 3,861,460 | 1/1975 | Lenhardt | 60/690 |
| 4,306,418 | 12/1981 | Nishioka | 60/693 |

*Primary Examiner*—Allen M. Ostrager
*Attorney, Agent, or Firm*—F. J. Baehr, Jr.

[57] ABSTRACT

A method of separating the two exhausts of a low pressure double flow turbine so that the turbine can be directly connected to a zoned or multi pressure condenser having a shell side low pressure chamber with influent cooling water in the tubes disposed therein and a shell side higher pressure chamber with effluent cooling water in the tubes disposed therein and utilizing structural elements within the turbine and baffling to form low leakage seals between the two chambers.

3 Claims, 3 Drawing Figures

METHOD OF FORMING A ZONE CONDENSER WITH A SINGLE LOW PRESSURE DOUBLE FLOW TURBINE

CROSS-REFERENCE TO RELATED APPLICATIONS

An application entitled "Single Low Pressure Turbine With Zoned Condenser" filed on June 15, 1984 and assigned Ser. No. 621,323 is closely related to this application and is hereby incorporated by reference herein.

BACKGROUND OF THE INVENTION

This invention relates to a zone condenser and more particularly to a method of zoning the condenser for a single double flow steam turbine.

Zone condensers have been utilized on turbines having multiple double flow low pressure elements where each separate low pressure double flow turbine element discharges in a different pressure condenser or portion of a condenser, but single element double flow low pressure turbines have not utilized zone condensers. Features disposed within the turbine casing such as inlet nozzles, pipes, top sealing diaphragms, support and alignment devices, extraction piping and connections, horizontal joint flanges, access openings, and feedwater heaters all present discontinuities to the axisymmetry of the turbine parts within the outer casing and complicate placement of baffles within the turbine necessary to cooperate with baffles within the condenser to form a zoned condenser.

SUMMARY OF THE INVENTION

In general a method for separating two exhaust ends of a double flow low pressure turbine and directing exhaust from one end of the turbine to a low pressure chamber in a shell and tube condenser and directing the exhaust from the other end of the turbine into a higher pressure chamber in the condenser, when made in accordance with this invention, comprises the steps of placing baffling within the shell side of the condenser so that a portion of the tubes designated to receive influent cooling water are in the low pressure chamber and a portion of the tubes designated to have affluent cooling fluid exit therefrom are in the high pressure chamber, placing baffling within the turbine generally parallel to, but displaced from a transverse center plane through the turbine, and utilizing existing structural elements within the turbine to cooperate with the baffling placed in the turbine and condenser to form a multipressure condenser.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
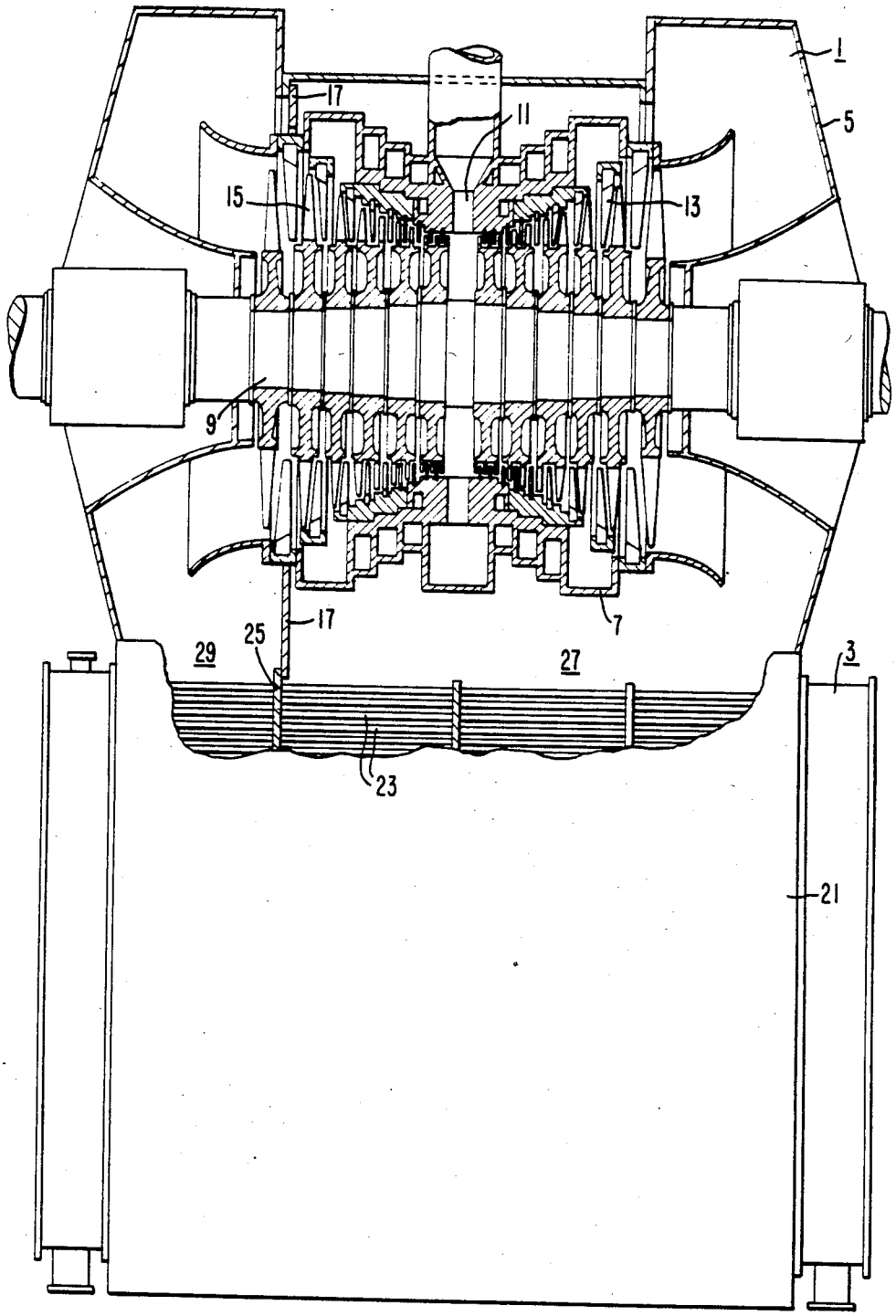
FIG. 1 is an elevational view partly in section showing a zone condenser and turbine made in accordance with this invention.

Referring now to the drawings in detail and in particular to FIG. 1 there is shown a low pressure double flow steam turbine element 1 and a condenser 3.

The turbine comprises an outer housing or casing 5, an inner casing 7 disposed within the outer casing 5 and a rotor 9 rotatably disposed within the inner casing 7 a steam inlet nozzle 11 is centrally disposed within the turbine 1 and brings inlet steam through the casings 5 and 7 to a plurality of interdigitated rows of stationary and rotatable blades 13 and 5 which form two steam flow paths which extend axially in opposite directions from the central portion of the turbine 1 toward the axial ends thereof. Baffling 17 is disposed asymmetrically between the inner and outer casing 7 and 5 and to the condenser 3. The baffling 17 is generally parallel to and offset from a transverse center plane disposed perpendicular to the axis of the turbine.

The condenser 3 has a shell 21 which encloses a plurality of generally straight tubes 23 through which cooling water flows. Steam is condensed on the outer side of the tubes 23 or the shell side. Baffling 25 is disposed in the shell 21 and is cooperatively associated with the baffling 17 in the turbine 1 to form two separate chambers, a low pressure chamber 27, shown on the right-hand side of FIG. 1, which contains portions of the tube having influent cooling fluid flowing therein and a high pressure chamber 29, shown on the lefthand side of FIG. 1, which contains portions of the tubes having effluent cooling water flowing therefrom.

Figure 2:
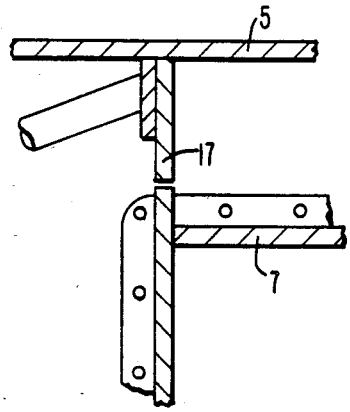
FIG. 2 is an enlarged partial sectional view of some of the baffling in the turbine.
Figure 3:
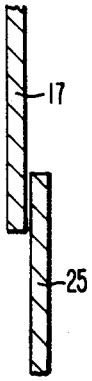
FIG. 3 is an enlarged partial sectional view of additional baffling.

As shown in FIGS. 2 and 3 the baffling 17 within the turbine utilizes structural elements within the turbine and controlled clearances to provide low leakage seals between the low and higher pressure chambers 27 and 29.

A method of separating the exhaust ends of a double flow low pressure turbine and directing exhaust from one end of the turbine into a low pressure chamber and directing the exhaust from the other end of the turbine into a higher pressure chamber in a shell and tube condenser comprises the step of:

placing baffling within the shell side of the condenser so that portions of the tubes designated to receive influent cooling water are disposed in the low pressure chamber and portions of the tubes designated to have effluent cooling water exit therefrom are disposed in the higher pressure chamber;

placing baffling within the turbine generally parallel to but displaced from a transverse central plane through the turbine;

utilizing existing structural elements with the turbine 1 to cooperate with the baffling 17 and 25 placed within the turbine 1 and condenser 3;

placing the baffling 17 in the turbine 1 in such a manner that the top half of the outer casing 5 can be easily removed;

providing control clearances between the baffling 17 and 25 and structural elements to provide low leakage seals which allow for thermal expansion in order to form a multi pressure or zoned condenser.

What is claimed is:

1. A method of separating two exhaust ends of a double flow low pressure turbine and directing exhaust from one end of the turbine to a low pressure chamber in a shell and tube condenser and directing exhaust from the other end of the turbine into a higher pressure chamber in the condenser, the method comprising the steps of:

placing baffling within the shell side of the condenser so that a portion of the tubes designated to receive influent cooling water are in the low pressure chamber in a portion of the tubes designated to have affluent cooling water exit therefrom are in the higher pressure chamber;

placing baffling within the turbine generally parallel to, but displaced from, a transverse center plane through the turbine; and utilizing existing structural elements within the turbine to cooperate with the baffling placed in the turbine and condenser to form a multi pressure condenser.

2. A method as set forth in claim 1, and further comprising the step of providing control clearance between the baffling within the turbine and the structural elements of the turbine to provide low leakage seals between the low and higher pressure chambers.

3. A method as set forth in claim 1 and further comprising placing the baffling in such a manner that the top half of the turbine can be easily disassembled.

* * * * *